US006281772B1

(12) United States Patent
Adams

(10) Patent No.: US 6,281,772 B1
(45) Date of Patent: Aug. 28, 2001

(54) DYNAMIC DAMPENING IN A FRICTIONLESS SOLENOID VALVE

(75) Inventor: Rory K. Adams, Kalamazoo, MI (US)

(73) Assignee: FEMA Corporation of Michigan, Portage, MI (US)

( * ) Notice: Subject to any disclaimer, the term of this patent is extended or adjusted under 35 U.S.C. 154(b) by 0 days.

(21) Appl. No.: 09/771,785

(22) Filed: Jan. 29, 2001

(51) Int. Cl.[7] ..... H01F 1/00; H01F 7/08

(52) U.S. Cl. ..... 335/277; 335/271; 251/129.16; 251/129.18

(58) Field of Search ..... 335/243, 247, 335/248, 249, 252, 255, 257, 258, 261, 262, 269, 270, 271, 274, 277; 251/129.01, 129.08, 129.15, 129.16, 129.18

(56) References Cited

U.S. PATENT DOCUMENTS

| | | | |
|---|---|---|---|
| 4,463,332 | 7/1984 | Everett | 335/258 |
| 4,664,136 | 5/1987 | Everett | 137/85 |
| 4,835,503 | 5/1989 | Everett | 335/229 |
| 4,932,630 | 6/1990 | Kumar et al. | 251/30.03 |
| 4,950,016 | 8/1990 | Kumar | 294/64.2 |
| 5,088,520 | 2/1992 | Haynes et al. | 137/270 |
| 5,108,071 | 4/1992 | Hutchings | 251/86 |
| 5,202,658 | 4/1993 | Everett et al. | 335/230 |
| 5,217,200 | 6/1993 | Hutchings et al. | 251/86 |
| 5,333,643 | 8/1994 | Gilchrist et al. | 137/605 |
| 5,386,849 | 2/1995 | Gilchrist et al. | 137/605 |
| 5,419,530 | 5/1995 | Kumar | 251/95 |
| 5,695,125 | 12/1997 | Kumar | 239/364 |
| 5,785,298 | 7/1998 | Kumar | 251/129.16 |
| 6,047,947 | 4/2000 | Kumar | 251/129.16 |

*Primary Examiner*—Raman M. Barrera
(74) *Attorney, Agent, or Firm*—Flynn, Thiel, Boutell & Tanis, P.C.

(57) ABSTRACT

A rectilinear motion solenoid having a housing, an annular coil of electrical wire mounted in the housing and having a central hole therethrough. A first magnetic pole piece is oriented adjacent a first axial end face of the annular coil and a second magnetic pole piece oriented adjacent a second end face of said annular coil. An armature is movably mounted in the central hole. Two substantially linear springs are provided for securing the armature to the housing to effect a frictionless resilient suspension of the armature in the central hole. A closed chamber is filled with a liquid so that a disk movable with the armature is also movable in the chamber. A perimeter of the disk is oriented in close relation to an interior wall surface of the chamber to define a liquid flow restricting gap therebetween and effecting during operation a dynamic dampening of armature movement.

6 Claims, 3 Drawing Sheets

DYNAMIC DAMPENING IN A FRICTIONLESS SOLENOID VALVE

FIELD OF THE INVENTION

This invention relates to a dynamic dampening mechanism for use in a frictionless rectilinear motion solenoid and, more particularly, a dynamic dampening mechanism for use in eliminating natural frequency oscillations in the solenoid.

BACKGROUND OF THE INVENTION

A prior art frictionless solenoid operable in association with a liquid controlling valve is illustrated in FIG. 1. The illustration in FIG. 1 represents the closest prior art known to the inventor.

The solenoid portion 10 of the solenoid operated valve 11 consists of an armature 12 suspended in the center of an annular coil 13 by a pair of flat substantially linear springs 14 and 16 attached to the armature 12 at one end and attached to the solenoid pole pieces 17 and 18 at the other end to prevent radial movements. The pole pieces 17 and 18 are oriented at the ends of the annular coil 13 and are connected together by a metal tube 19 made of a magnetic material which is oriented around the outside of the annular coil 13. The tube serves the purpose of completing the flux carrying magnetic circuit.

The pole piece 17 oriented to the left of the annular coil has a large opening 21 in it and is adapted to receive therein the armature 12. The radial space between the outside diameter of the armature 12 and the inside diameter of the opening 21 serves to define a non-working air gap 22. This end of the armature also has an elongate rod 23 formed on the left axial end face of the armature and it is this rod 23 that is secured to the aforesaid spring 14. A hole in the center of the spring 14 allows the rod 23 to extend therethrough. A resilient spacer 24 is provided to space the spring 14 from the axial end face of the armature 12 and a retainer ring 26 is utilized to hold the spring 14 against the resilient spacer 24.

The opposite pole piece 18 also has a hole 27 extending therethrough. The armature has a non-magnetic rod 28 formed on the right axial end face of the armature and extends axially away therefrom into and through a hole in the spring 16 whereat it is fixedly attached to the rod 28. The two springs 14 and 16 serve to suspend the armature 12 and the two axially protruding rods 23 and 28 in the respective holes through the pole pieces 17 and 18 as well as through the central hole in the annular coil 13 so as to create a frictionless support for the armature.

In this particular prior art construction, a liquid control valve is oriented at the right end of the housing 29 which houses the aforesaid armature 12 and annular coil 13. The liquid control valve 31 includes a central bore 32 therethrough having a plurality of liquid ports therein, namely, a liquid supply port 33, a control port 34 and a tank port 36. A nozzle 37 is provided in the bore 32 between the supply port 33 and the tank port 36 axially spaced from the supply port 33. The nozzle 37 has a nozzle opening 38 therein so that liquid supplied through the supply port 33 to the control port 34 is bled through the nozzle opening 38 to the tank port 36 when a button 39 fixedly secured to the rod 28 and movable therewith is spaced away from the nozzle opening 38 as illustrated in FIG. 1.

The right axial end face of the armature 12 is normally axially spaced from the left axially facing surface of the pole piece 18 when the annular coil 13 is not electrically energized. The axial space defines a working air gap 41. As a result, when the annular coil 13 is electrically energized, the armature 12 will be driven rightwardly toward the pole piece 18. In addition, the right axial end face 42 will move into close relation with the nozzle opening 38 to block liquid flow from the control port 34 to the tank port 36. As a result, pressure will build up in the control port 34 to effect an appropriate drive of a mechanism connected thereto.

Electrical energy is supplied to the annular coil 13 through a electrical connection 43.

Due to the precise control and response required from this type of solenoid operated liquid valve, and recognizing that these solenoid operated valves are sensitive to variations and changing conditions within the total liquid (here hydraulic) system, these variations can lead to an undesirable natural frequency oscillation in the armature 12. Such items that influence the sensitivity are fluid viscosity changes due to temperature change, changes in the resilience of rubber components and also any spring loading that may be provided in valve arrangements which include spring loaded control spools. Variations caused by these system components are unacceptable. The invention set forth herein successfully resolves the issue of natural frequency system oscillations.

SUMMARY OF THE INVENTION

A rectilinear motion solenoid having a housing, an annular coil of electrical wire mounted in the housing and having a central hole therethrough. A first magnetic pole piece is oriented adjacent a first axial end face of the annular coil and a second magnetic pole piece oriented adjacent a second end face of said annular coil. An armature is movably mounted in the central hole. Two substantially linear springs are provided for securing the armature to the housing to effect a frictionless resilient suspension of the armature in the central hole. A closed chamber is filled with a liquid so that a disk movable with the armature is also movable in the chamber. A perimeter of the disk is oriented in close relation to an interior wall surface of the chamber to define a liquid flow restricting gap therebetween and effecting during operation a dynamic dampening of armature movement.

BRIEF DESCRIPTION OF THE DRAWINGS

Other objects and purposes of this invention will be apparent to persons acquainted with apparatus of this general type upon reading the following specification and inspecting the accompanying drawings, in which.

DETAILED DESCRIPTION

Figure 1:
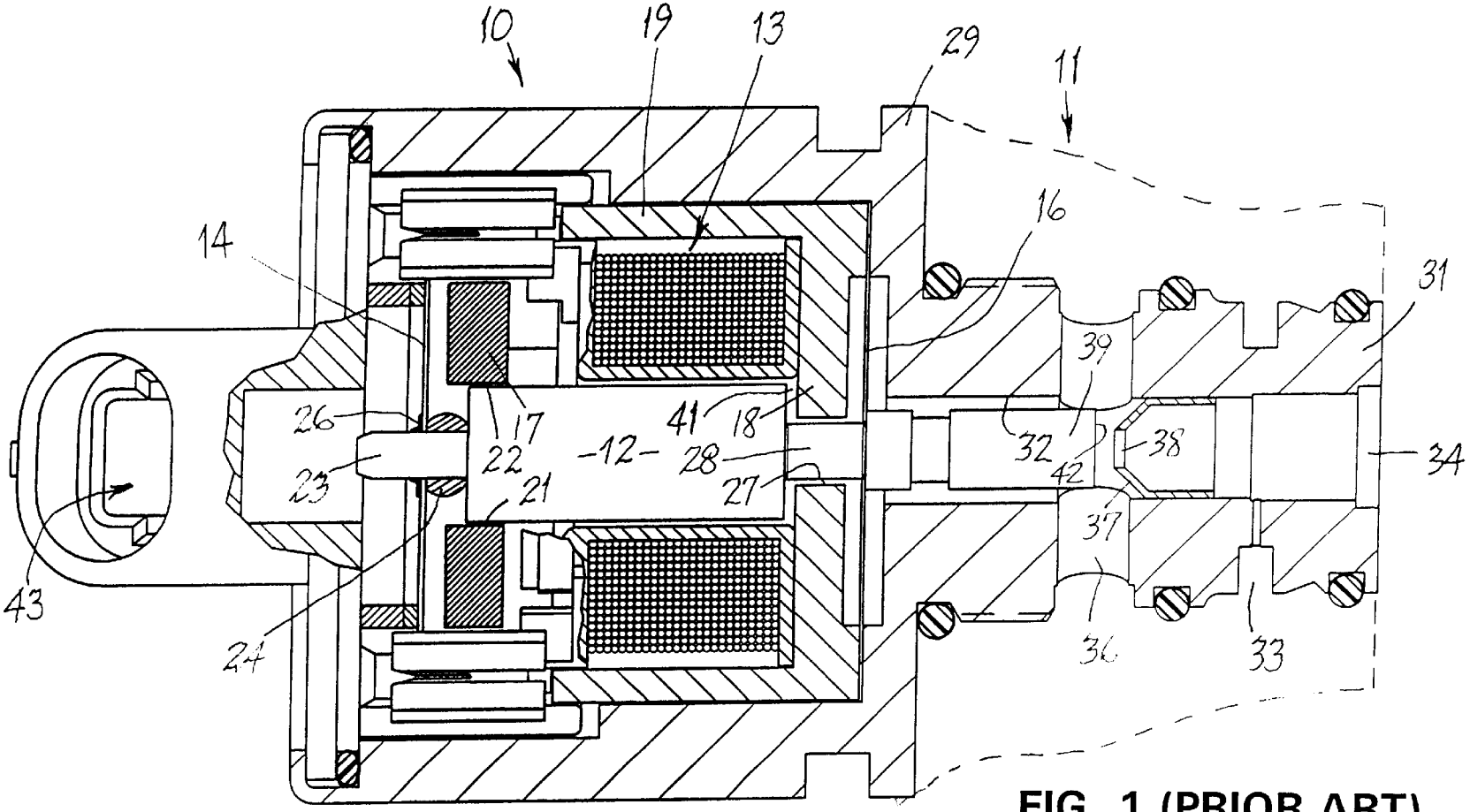
FIG. 1 (PRIOR ART)
FIG. 1 illustrates a prior art frictionless solenoid operated valve.
Figure 2:
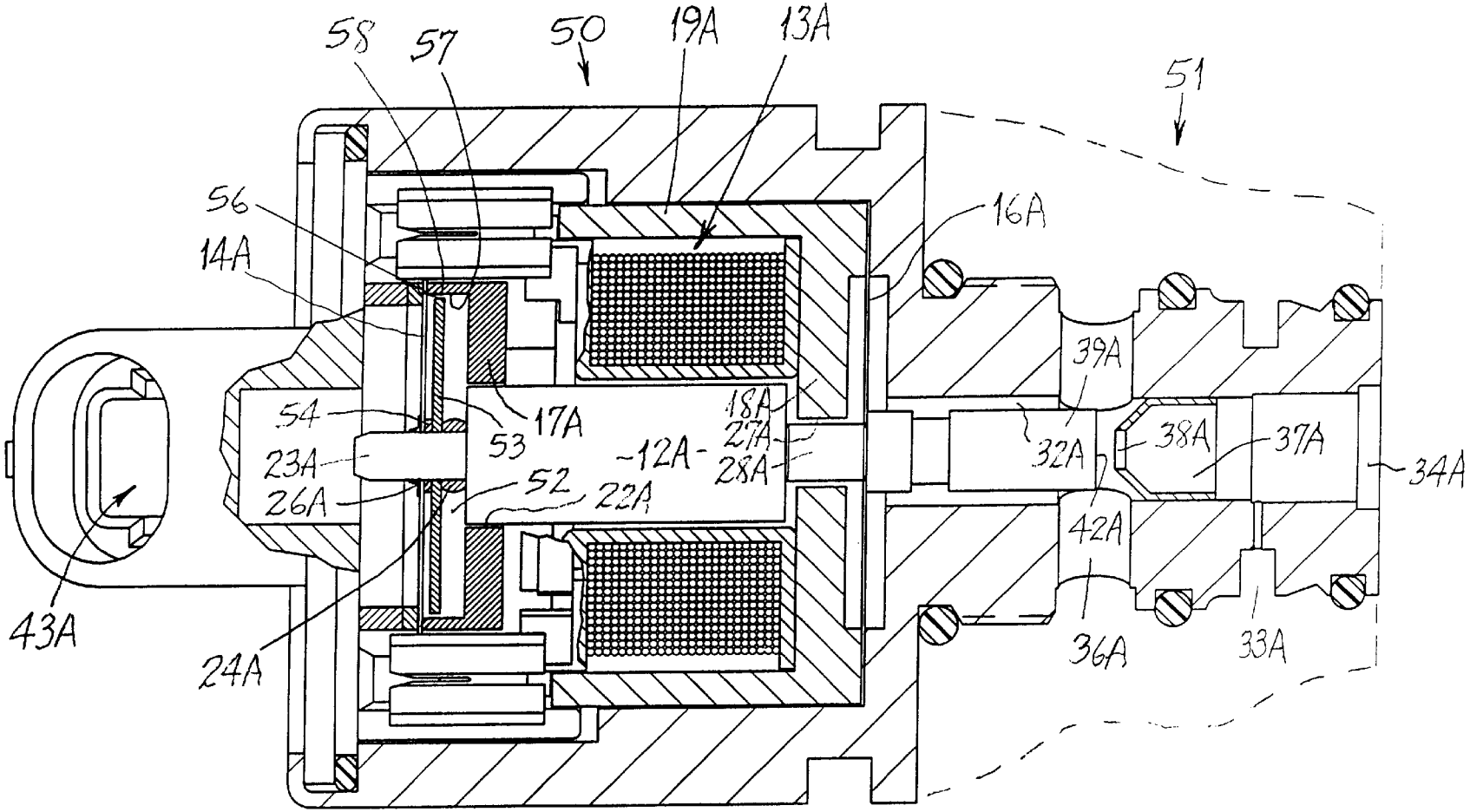
FIG. 2 illustrates a frictionless solenoid operated valve including the invention therein.
Figure 3:
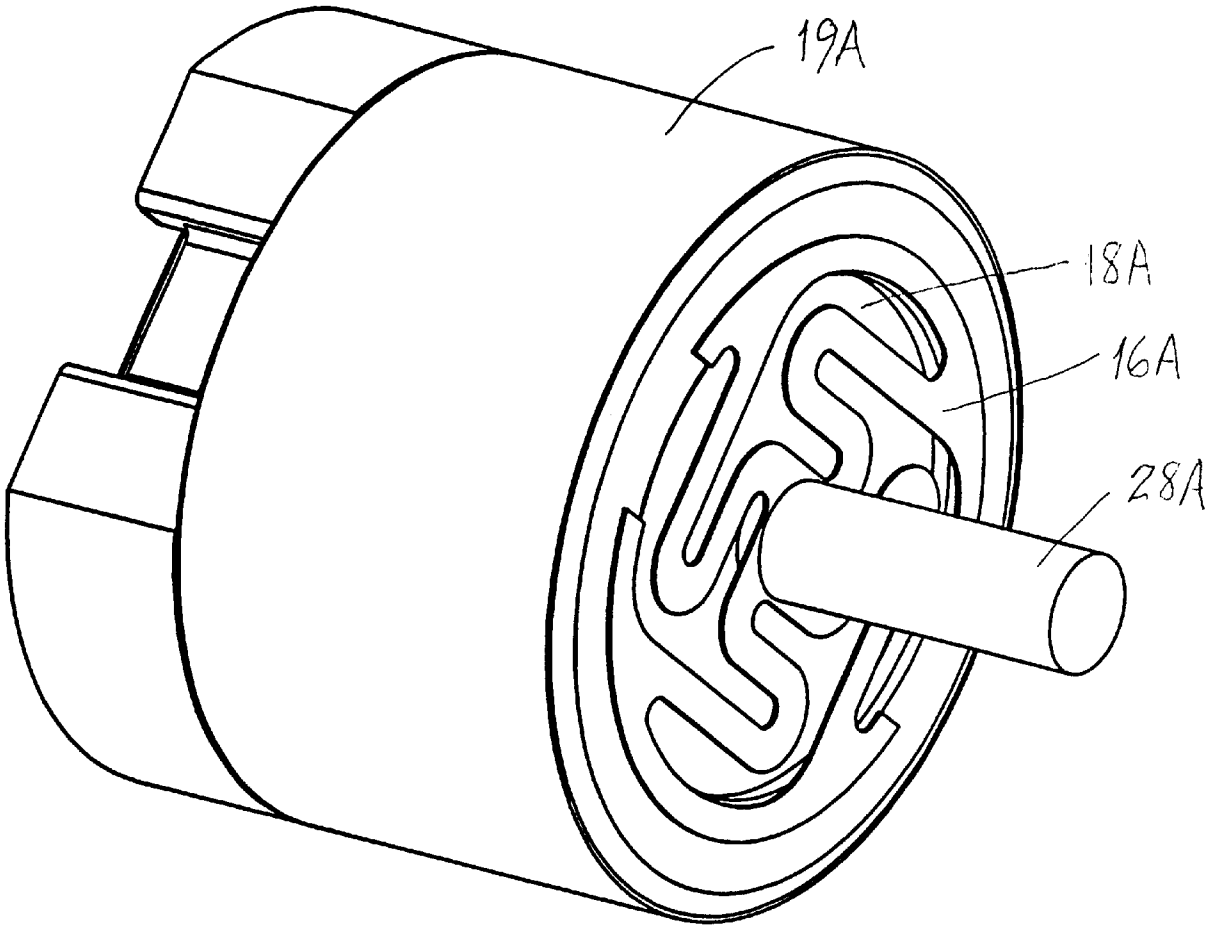
FIG. 3 is an isometric view of a fragment of the left pole piece and linear spring 14.

FIGS. 2 and 3 illustrate the inventive solenoid 50 associated with a fluid valve 51. It will be readily apparent that the valve 51 is identical in construction to the valve 11 shown in the prior art device illustrated in FIG. 1. Therefore, further discussion about the operative characteristics of the valve 51 will not be further explained.

Turning now to the inventive solenoid 50, it will be noted that the reference numerals used to describe this solenoid 50 are the same as has been used in describing the solenoid 10, except that the suffix "A" has been added to each reference numeral. Taking note of this reference numeral characteristic, it will be noted that the left pole piece 17A has been altered to create an axially facing chamber 52 therein. A disk 53 is fixedly secured to the rod 23A between the resilient spacer 24A and a further spacer 54 separating the disk 53 from the spring 14A. The spring clip 26A serves to secure the spring 14A against the spacer 54 and to hold the disk 53 and the spacer 24A in the respective location on the rod 23A as illustrated in FIG. 2. A radial gap 56 exists between the internal diameter of the wall surface 57 of the chamber 52 and the radially outwardly facing surface 58 of the disk 53 so as to cause the radial gap 56 to define a liquid restriction.

It will be noted that the valve construction 51 (also the valve construction 11) is connected in liquid circuit through various radial clearances to the interior of the solenoid 50. More specifically, liquid is allowed to travel in the bore 32A through the spring 16A and the radial clearance between the rod 28A and the hole 27A in the pole piece 18A as well as through the radial clearance between the outside diameter of the armature 12A and the inside diameter of the annular coil 13A as well as through the non-working air gap 22A into the aforesaid chamber 52 as well as through the liquid restriction gap 56. The disk 53 has a large surface area on the axially facing sides thereof coaxially aligned with the axially facing end surface of the armature 12A. As a result, this large surface area is communicated with the remaining areas in the solenoid by way of the restricted area around the perimeter of the disk 53 to the non-working air gap and other portions of the solenoid 50 and the valve 51. Liquid supplied to the tank port 36A is the supply for the liquid in the interior of the solenoid 50.

As described previously in the prior art solenoid construction 11, when conditions in the system try to cause the armature 12A to oscillate rapidly (move back and forth axially), the disk 53, which is attached to the armature 12A, must also be oscillated. In order to oscillate the armature 12A and the disk 53 secured thereto, the area or volume in between the disk 53 and the portion of the chamber 52 oriented to the right of the disk 53 will either require liquid to fill it or be displaced from it by way of the restrictions around the disk 53 and the armature 12A. This transfer of liquid from one side of the disk 53 to the other creates a differential pressure from one side of the disk to the other. This differential pressure applied to the disk surface area creates an axial load on the disk/armature assembly in opposition to the direction of the oscillation.

Due to the relatively large area of the disk 53, the volume of liquid which must pass from one side of the disk to the other through the restriction gap 56 can be quite large with a relatively small movement of the armature 12A, creating a high differential pressure. With this large liquid transfer, the high differential pressure will create a high opposition load on the disk/armature assembly thereby limiting the magnitude of or preventing the start of system oscillations.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A rectilinear motion solenoid, comprising:

a housing;

an annular coil of electrical wire mounted in said housing and having a central hole therethrough;

a first magnetic pole piece oriented adjacent a first axial end face of said annular coil and a second magnetic pole piece oriented adjacent a second end face of said annular coil, said first and said second pole pieces being coupled together by a third magnetic piece;

a first hole through said first pole piece coaxial with said central hole;

a second hole through said second pole piece coaxial with said central hole;

an armature of magnetic material rectilinearly movably displaceably mounted in said central hole with sufficient radial clearance therebetween and having non-magnetic rod parts projecting coaxially from axially facing ends thereof, a first one of said non-magnetic rod parts being coaxially received in said first hole with sufficient radial clearance therebetween, an end of said armature remote from said first rod part being coaxially received in said central hole with sufficient radial clearance therebetween and to define a non-working air gap;

first and second substantially linear spring for securing respective said first and second rod parts to said housing to effect a frictionless resilient suspension of said armature in said central hole and to orient an annular axial end face of said armature adjacent said first rod part in opposing relation to said first pole piece to define a working air gap therebetween;

a closed chamber filled with a liquid, said second rod part operatively coupled to a member oriented in said chamber, a disk mounted on said member for movement therewith, a perimeter of said disk being oriented in close relation to an interior wall surface of said chamber to define a liquid flow restricting gap therebetween and effecting during operation a dynamic dampening of armature movement.

2. The rectilinear motion solenoid according to claim 1, wherein said chamber is formed in said second pole piece.

3. The rectilinear motion solenoid according to claim 2, wherein said member is an integral extension of said second rod part.

4. The rectilinear motion solenoid according to claim 1, wherein said chamber openly communicates through said non-working air gap and said radial clearances so that said liquid is present therein.

5. The rectilinear motion solenoid according to claim 4, wherein said housing includes a liquid control valve having a liquid supply port adapted to receive a supply of said liquid thereto from a supply, a control port adapted for connection to a load and a tank port adapted for communication to said supply, said tank port operatively communicating with said chamber.

6. The rectilinear motion solenoid according to claim 5, wherein said tank port operatively communicates with said chamber through said radial clearances and said non-working air gap.

* * * * *

UNITED STATES PATENT AND TRADEMARK OFFICE

CERTIFICATE OF CORRECTION

PATENT NO. : 6,281,772 B1
DATED : August 28, 2001
INVENTOR(S) : Rory K. Adams

It is certified that error appears in the above-identified patent and that said Letters Patent is hereby corrected as shown below:

Column 4,
Line 23, change “central hole” to -- second hole --.

Signed and Sealed this

Twenty-sixth Day of November, 2002

*Attest:*

*Attesting Officer*

JAMES E. ROGAN
*Director of the United States Patent and Trademark Office*